United States Patent [19]

Rouzaud

[11] 3,962,891

[45] June 15, 1976

[54] KNITTING MACHINE

[75] Inventor: Guy Charles Rouzaud, Chatenay-Malabry, France

[73] Assignees: Centre Technique Industriel dit: Institut Textile de France, Boulogne-sur-Seine; Société Anonyme dite: Jaeger, Levallois-Perret, both of France

[22] Filed: Mar. 20, 1975

[21] Appl. No.: 560,223

[52] U.S. Cl. ..... 66/132 R

[51] Int. Cl.[2] ..... D04B 15/48; D04B 15/50

[58] Field of Search ..... 66/132, 125, 131, 126, 66/127, 128

[56] References Cited

UNITED STATES PATENTS

| | | | |
|---|---|---|---|
| 3,364,703 | 1/1968 | Krause | 66/126 R |
| 3,396,558 | 8/1968 | Taylor | 66/132 |
| 3,461,692 | 8/1969 | Raisin | 66/132 |
| 3,550,400 | 12/1970 | Peat et al. | 66/82 S |
| 3,566,134 | 2/1971 | Peat et al. | 66/82 R |

*Primary Examiner*—Ronald Feldbaum
*Attorney, Agent, or Firm*—Bacon & Thomas

[57] ABSTRACT

A yarn supply device for a rectilinear knitting machine capable of supplying the needles of the machine with a predetermined quantity of yarn irrespective of the speed of operation of the machine. The supply device comprises a yarn feed unit incorporating a drive member such as a pulley around which the yarn is wound in order to obtain positive drive engagement, the pulley being driven by an electric motor energized with an error signal derived from the output signal of a transducer sensitive to the actual displacement speed of the yarn feed device, and a signal representing the desired speed derived from the displacement and speed of a cam bar and thrower bar of the knitting machine. Arrangements are made for compensation in the error signal for the different stretch in the yarn in dependence on the position of the thrower with respect to a fixed yarn guide, and also for the inertia of the drive member of the yarn feed unit.

20 Claims, 10 Drawing Figures

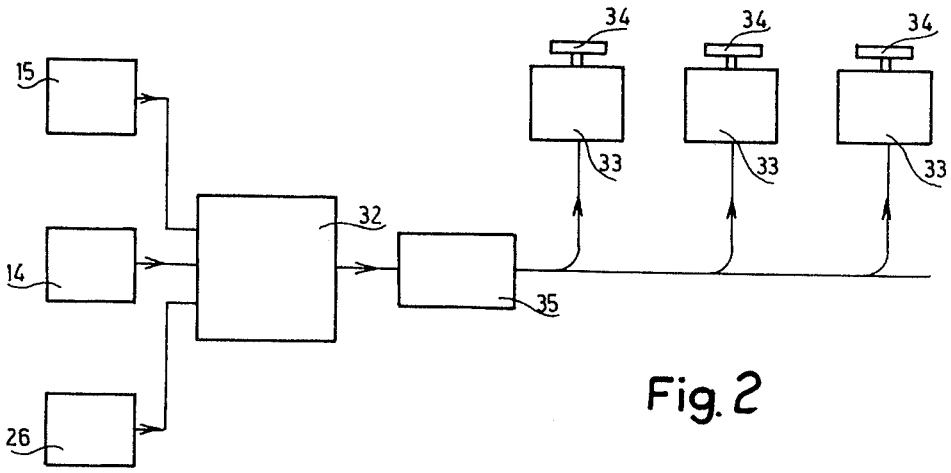
Fig. 2
Fig. 3a
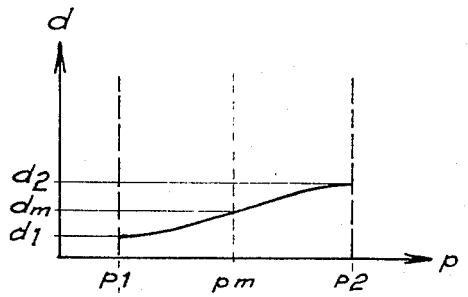
Fig. 3b
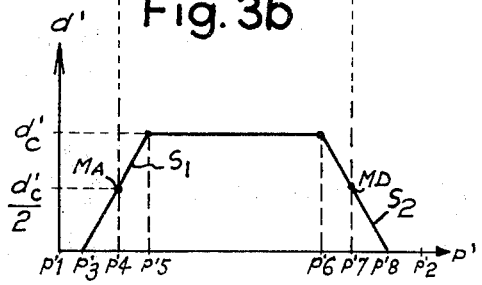

48
49
74
73
72
68
67
66
71
70
69
75
1
α

65
66
67
68
76
77
78
79
80
81
82
83
84

KNITTING MACHINE

The present invention relates to an installation associated with a rectilinear knitting machine, capable of supplying a predetermined quantity of yarn in dependence on the dimensions of the stitch required, whilst maintaining the conditions of tension required for knitting, the said knitting machine comprising at least one cam and one thrower each driven to-and-fro by a cam bar and thrower bar whose movement is linked with that of the said cam bar; there being provided for each thrower, and mounted in series, a yarn stocking spool, a positive yarn feed device, a yarn take-up device, and a fixed yarn guide located in the median vertical plane perpendicularly to the working travel of the corresponding thrower, the travel being limited by end-of-travel stops.

When knitting, there are many variable factors which can adversely affect and modify the dimensions of the pieces of knitted material. The influence of these factors is more or less connected with frictional effects which appear when the stitch is formed and which change the dimension of the loop.

These factors include: the type of yarn used, its method of preparation, the adjustment of the machine, the rate of production of the stitches and the tension in the yarn feed. Consequently, the effort required to unwind the yarn from the spool is not constant and in particular, the variation in the coefficient of friction of the yarn causes the yarn to stretch more or less at different times, thus producing a variation of the length of yarn taken up by each stitch. For these reasons, it is difficult to obtain a batch of uniformly knitted pieces and a number of these, that is those whose dimensions differ too greatly from the set standards, must be rejected.

In order to overcome this difficulty, it has been suggested, for example in U.S. Pat. No. 3,461,692 to provide a yarn feed installation capable of supplying each needle under constant tension with a constant amount of yarn. This mechanical installation uses for this purpose, a mobile yarn guide located in a median vertical plane, whose distance relative to the thrower is maintained constant by means of a distance compensation device which acts on the said mobile yarn-guide in dependence on the position of the thrower bar. In this case, the feed unit is driven by the main shaft of the machine through an electro-magnetic coupling and is checked by an electromagnetic brake which, like the said coupling, is controlled in dependence on the position of the thrower bar.

However, this installation is difficult to operate, particularly because of the violent accelerations and decelerations imparted to the yarn feed unit and the mobile yarnguide whose instantaneous positions can only be related with great difficulty, to the accelerations and decelerations of the said feed unit.

The present invention eliminates these disadvantages and provides installation of the above mentioned type in which it is possible to supply each needle with a predetermined quantity of yarn, independently of the speed of operation of the machine.

According to the invention there is provided a yarn supply device for a rectilinear knitting machine of the type including at least one cam driven to reciprocate by a cam bar, and at least one thrower driven by a thrower bar the movement of which is linked to that of the cam bar, the yarn feed device being operable to supply the needles of the knitting machine with a predetermined quantity of yarn in dependence on the stitch sizes, whilst maintaining all the tension conditions necessary for the knitting process and including for each thrower, a yarn spool, a yarn-feed unit, a yarn take-up device, a fixed yarn guide located in the median perpendicular plane of the needle bed, and an electrical drive system the speed of which is controlled in dependence on the positions and speeds of displacemnt of both the cam bar and the thrower bar.

In embodiments of the invention it is thus possible to ensure that each needle, whatever its position in the row, is provided with a predetermined quantity of yarn, independently of the speed of knitting.

The actual quantity of thread supplied is variable and is linked to the position and speed of displacement of the cam and thrower bars; this quantity is also given a coefficent which is a function of the selected "tightness" that is to say the length of yarn taken up by each stitch, and which is adjustable according to the type of knitted material required.

Two transducers connected, for example, mechanically, one to the thrower bar, and the other to the cam bar, deliver electrical signals in dependence on the position and the speed of displacement of the said bars. In the same manner, a third transducer, connected, for instance, to a positioning device of the end-of-travel stops of the thrower bar, which stops define the edges of the knitted material, delivers an electrical signal representing the position of these stops. The signal produced by the three transducers are fed to a processing circuit which transmits instructions to a control circuit of the drive motor of at least one feed unit. In this manner, the transducers connected to the thrower and cam bars convert the elementary displacements of these bars into electrical signals corresponding to the requisite instantaneous outputs of yarn which are constantly compared in a comparator, with an electrical signal of opposite sign, representing the actual yarn output and transmitted by an encoder driven by the feed unit; the sum of these two types of signals always be zero.

In order to obtain an output of yarn as close as possible to the requirements of the needles, it is of advantage to introduce certain refinements into the basic installation described hereabove. The first of these refinements is connected with the fact that on a machine of the Cotton type, the fixed yarn-guide is located in the median vertical plane, perpendicularly to the working travel of the corresponding thrower. Thus, the length of the portion of yarn between the fixed yarn-guide, of the supply unit, and the thrower, varies in dependence on the latter's position. In order to supply each needle with an equal quantity of yarn, it is necessary to take this variation in yarn length, into account. The variation in the length of the portion of yarn between the fixed yarn-guide and the thrower, is compensated for by suitably altering the speed of rotation of the feed unit. If the angle formed, at any moment, between this portion of yarn and the vertical line passing through the fixed yarn-guide is termed $\alpha$, the speed of rotation of the feed unit will be given by $(1 \pm \sin\alpha)$ the sign being chosen in dependence on the direction of displacement of the thrower bar.

A further refinement consists in taking into account the acceleration and deceleration of the yarn, which when being picked up at the edge, can be in excess of 100g. In actual fact, in order to provide the yarn with such an acceleration or deceleration, it would be necessary to use excessively large drive motors and brakes, which would consume a large amount of electrical power. The acceleration and deceleration of the yarn feed unit can be limited, however, to a lower value (say, of the order of 20g) which allows the use of reasonably sized motors, which are nevertheless capable of driving feed unit pulleys of some considerable inertia. This limitation of acceleration and deceleration of the yarn feed unit is achieved by controlling the speed of rotation of the feed unit motor, by means of an electrical ramp waveform of predetermined form and having a slope which corresponds to this acceleration; the deceleration of the feed unit at the end of the picking is subjected to the same ramp which is adapted to the displacement of the cam bar and is symmetrical on both sides, at the start and end of the movement.

Because of the limiting of the acceleration and deceleration of the yarn feed unit, there is provided between the yarn supply unit and the yarn guide, a yarn take-up device which makes it possible to compensate for the difference between the output of yarn supplied and the output of yarn required by the needles at the beginning and end of picking.

Because of the symmetrical form of the electrical ramp, the yarn store, which is formed by the yarn take-up device, which has two fixed yarn-guides, is replenished between the start of the feed and the start of the picking, on one hand, and between the end of the picking and the end of the feed, on the other hand.

The yarn take-up device must ensure an average tension of the yarn of, for example, between 3g and 10g. Moreover, it is subject to a tension law such that, for example a variation of 2cm in the stock (of yarn) causes a variation in tension of 1g. In addition the installation is so formed that it can supply the required amount of yarn whatever the tension adjustment of the machine, this adjustment being the length of yarn to be supplied for a given gauge of needles and a given form of stitch. For this purpose, a manual adjustment makes it possible to set the length of the output yarn (LFD) in dependence on the length required (LFA). This is a single adjustment of the machine which acts on the speed of the supply units of all the throwers.

Various embodiments of the invention will now be more particularly described, by way of example, with reference to the accompanying drawings, in which:

FIG. 2 is a block diagram showing the electrical connection of the various elements of the installation of FIG. 1;

FIGS. 3a and 3b illustrate the changes in the yarn output in dependence on the displacement of the thrower (FIG. 3a) and the displacement of the cam (FIG. 3b);

Figure 1:
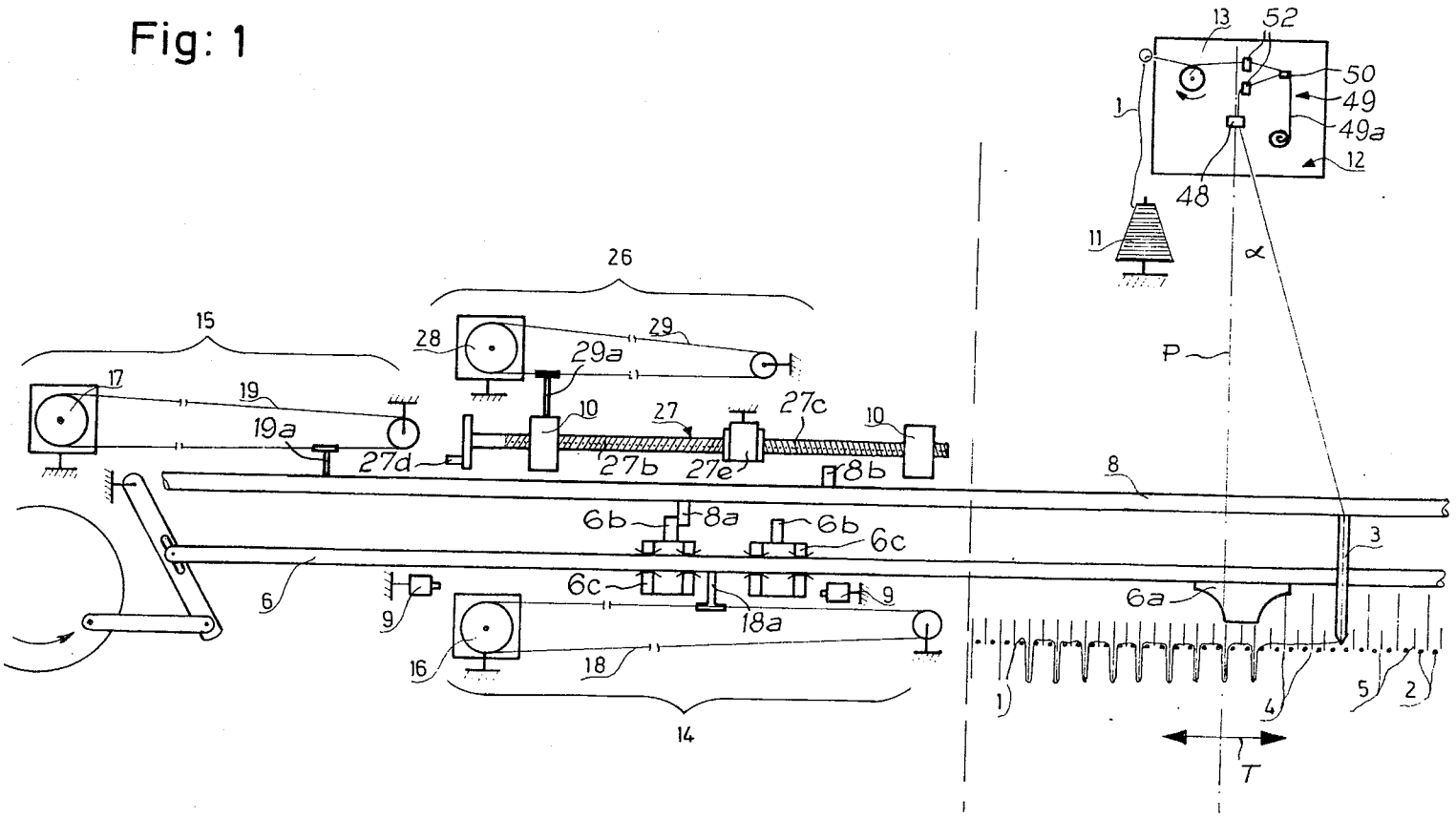
FIG. 1 is a schematic diagram illustrating one form of installation according to the invention, mounted in a rectilinear knitting machine.

As can be seen from FIG. 1, yarn 1 is deposited on needles 2 by means of thrower 3, the stitch being formed by gathering sinkers 4 and shaping sinkers 5, in the conventional manner. The gathering sinkers 4 are actuated by a cam 6a mounted on a cam bar 6 which drives a thrower bar 8 by means of dogs 6b joined to the bar 6 by a friction device 6c, which dogs 6b engage against a driving pin 8a, projecting laterally from the bar 8. The travel of the thrower bar 8, which determines the distance apart of the edges of the piece of material to be knitted, is determined by adjustable stops 10 which are abutted by a lug 8b on the thrower bar 8. Two fixed position stops 9 limit the travel of the friction device 6c.

The yarn 1 coming from a spool 11 passes through a positive drive feed unit 12 which essentially comprises a pulley 13, a drive motor for the pulley 13, controlled in dependence on the displacements of the thrower bar 8 and the cam bar 6, a yarn take-up device 49 comprising two fixed yarn-guides 52 and a mobile yarn guide 50 mounted on a leaf spring 49a, as well as a fixed yarn-guide 48 mounted in the median vertical plan P of the machine and perpendicular to the direction of movement T of the thrower 3.

The position and the speed of displacement of the bars 6 and 8 are converted into electrical signals by appropriate transducer devices 14, 15, mechanically connected to each of these bars. The transducer 14 is connected to the cam bar 6 and the transducer 15 is connected to the thrower bar 8 and each comprise a pulley 16 or 17 driven by the corresponding bar 6 or 8 by means of a notched endless belt 18 or 19, and a peg 18a or 19a joined to one side of the belt 18 or 19 and the corresponding bar 6 or 8.

The pulleys 16 or 17 are given an alternating movement depending on the direction of displacement of the corresponding bar 6 or 8; they are mounted on a driving shaft 16a, 17a acting (see FIG. 4) on an optical encoder 20 and 21 delivering pulses the pulse repetition frequency of which is representative of the speed of rotation of the pulley 16 or 17, and therefore, of the speed of displacement of the corresponding bars 5 or 8. Moreover, the shaft 16a or 17a acts through a reduction gear 24 or 25, of appropriate ratio, on the wiper of a potentiometer 22 or 23, the position of the wiper being representative of the position of the corresponding bar 6 or 8.

Similarly, the position of the end-of-travel stops 10 which engage the lug 8b of the thrower bar 8 and thus define the width of the material to be knitted in converted into an electrical signal by means of a transducer 26 which is similar to the two transducers 14, 15 described above, and which likewise includes a pulley 28 driven by a notched endless belt or similar device 29. However, in this case the shaft 28a of the pulley 28 only drives, through reduction gear 31, the wiper of a potentiometer 30, the position of which is thus representative of the position of the end stops 10, and therefore, of the edges of the material being produced.

The stops 10 are carried on an adjuster 27 which consists of a spindle having two sections 27b, 27c threaded in opposite directions, each of which engages one of the stops 10 which are, for this purpose, drilled and tapped, and are guided for movement parallel to the spindle 27, in such a way that they cannot rotate with the spindle as this is turned. Rotation of the spindle can be effected by a handle 27d. The spindle 27 is mounted so that it can rotate but not move axially, in a support bearing which separates the two sections 27b, 27c and is located mid-way between the two stops 10.

The movements of the stops 10 are identical but in opposite direction, when the spindle 27 is rotated; one of the stops 10 is rigidly connected to a peg 29a which is connected to the notched endless belt 29.

The signals transmitted by the three transducers 14, 15 and 26 are treated in a processing circuit 32 which supplies the necessary instructions to the control circuit 33 of the motor 34 which drives the pulley 13 of the supply unit 12.

In a machine with several throwers 3 on a single thrower bar 8, there would be several supply units 12, and the instructions generated by the processing circuit 32 would be distributed in parallel to each drive unit 34 by means of a connecting circuit 35 (see FIG. 2).

The signals received by the processing circuit 32 are of two types, either D.C., when they come from the potentiometers 22, 23, 30, or pulses when they come from the optical encoders 20, 21. The pulses coming from the encoders 20, 21 represent increments of the advance of the bars 6 and 8, and they are of constant width. The signals coming from the potentiometers 22, 23, convert into D.C. but variable voltage, the instantaneous position of the bars 6 and 8, and are used to correct the information relating to the advance of the said bars provided by the pulses. The corrections of the information coming from the encoders 20, 21, are effected by modulation of the amplitude of the corresponding pulses in dependence of the output voltages of the potentiometers 22, 23. These two types of signals are treated in the same manner, in the processing circuit 32. The pulses supplied by the encoder 21, which are representative of the displacement of the thrower bar 8, are sent to a device 36 in which they are, conventionally, differentiated and shaped, so as to produce output signals of defined width. This device 36 also functions as an impedance matcher, and supplies, at the output, the power required for controlling all the motors 34. The continuous signal coming from the potentiometer 23, in dependence on the position of the thrower bar 8, is sent to a correction device 37, capable of providing an electrical voltage output corresponding to the law of correction of the rotation speed of the pulley 13 of the supply unit 12 in dependence on the position of the thrower 3 in relation to the median vertical plane P, that is to say ($1 \pm \sin\alpha$), where $\alpha$ is the angle between the median plane P and the length of yarn 1 going from the yarn-guide 48 to the thrower 3, as shown in FIG. 1.

Figure 7:
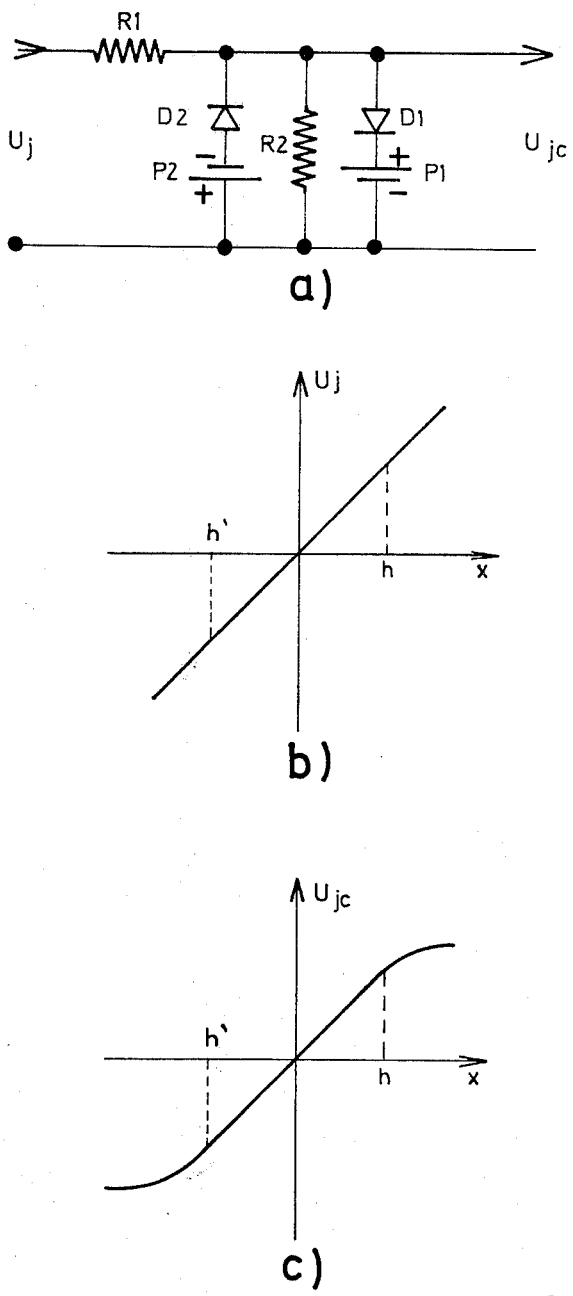
FIG. 7 is an example of a type of processing circuit for the correction signal which compensates for the position of the thrower relative to the fixed yarn-guide.

The correction device 37 is, for example, of the form shown in FIG. 7a in which two diodes $D_1$ and $D_2$ are mounted in anti-parallel, each being in series with means for producing a bias voltage, indicated $P_1$ and $P_2$. The input voltage is of the form shown in FIG. 7b and the output voltage is illustrated by FIG. 7c, these two curves being symmetrical, each of the diode-bias assemblies acts on a part of the said curve, the centre of symmetry of the curve representing the median plane P. The action of the voltage supplied by each of the diodes is delayed, by means of the bias $D_1$, $D_2$ up to the points $h$ and $h'$, starting from which, the curve becomes infected according to the required law, due to the saturation curve of the diode. This voltage is then fed to an impedance matcher 38 which makes it possible to supply the power required for the control of all the motors 34 through the control circuit 33.

FIG. 3a shows the variation in the output of yarn, that is to say, of the speed of rotation of the pulley 13 of the feed unit 12, it being understood, that the yarn 1 is adequately wound around the pulley 13 and does not slip relatively to the surface of the pulley 13, this surface presenting a high coefficient of friction. The diagram of FIG. 3a shows on the Y-axis, the output of yarn as a function of the position $p$ (X-axis) of the thrower 3 between the two ends of its working travel.

Assuming that the thrower 3 is displaced from left to right between the two extreme positions $P_1$ and $P_2$ corresponding to the positions of stops 10 and therefore also, to the edges of the piece of material to be knitted to the position $P_m$ corresponding to that of the thrower 3 when it is in the mid position passing through the median plane P, which also includes the yarn-guide 48, at a distance equally spaced from the two extreme positions $P_1$ and $P_2$. If in the position $p_m$ of the thrower 3, the corresponding output of yarn $d_m$ is equal to 1, the outputs of yarn $d_1$ and $d_2$ at the extreme positions must be respectively equal to ($1 - \sin\alpha$) and ($1 + \sin\alpha$), $\alpha$ having the same definition as previously given. This variation in the output of yarn $d$ at the level of the supply unit 12 makes it possible to take into account the variation in the distance between the fixed yarn-guide 48 and the thrower 3. But onto this variation of yarn output $d$ caused by the position of the thrower 3 relatively to the yarn-guide 48, must be superimposed another variation which takes into account the fact that the supply unit 12, or more accurately, its pulley 13 has a certain inertia and cannot be instantaneously accelerated or decelerated as would be necessary, in principle. The methods of achieving this second variation in yarn output will be subsequently explained.

In the same manner, the pulses supplied by the encoder 20 and representing the displacement speed of the cam bar 6, are differentiated and shaped in an appropriate device 39 which supplies at the output, pulses of controlled width, which are then sent to an impedance matcher 40.

Figure 4:
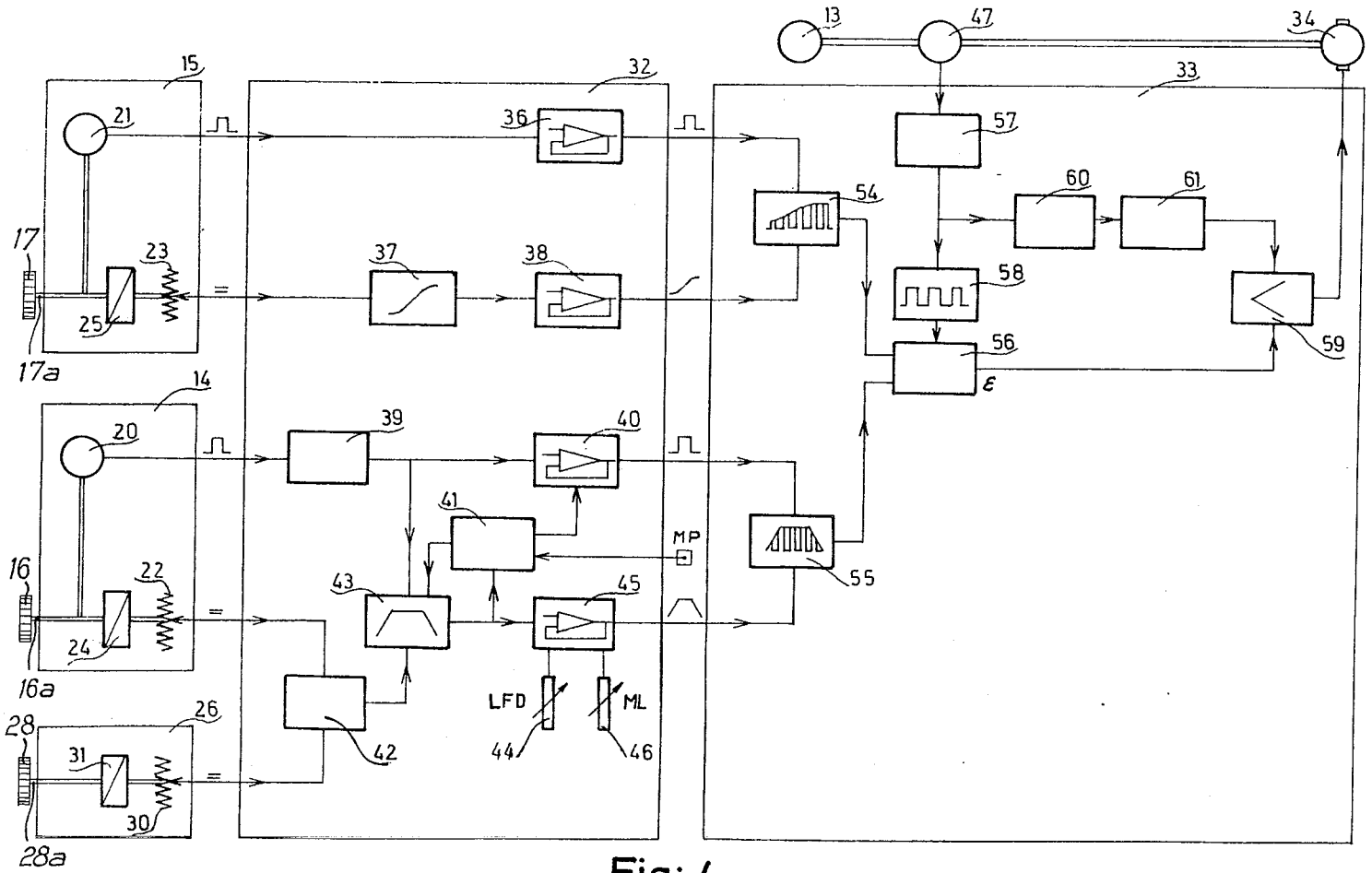
FIG. 4 is a block diagram of a complete installation formed as an embodiment of the invention.

The methods which make it possible to achieve a variation in the speed of the supply unit 12, and which take into account the latter's inertia with regard to its acceleration and deceleration, will be described with the help of FIGS. 1, 3b and 4. In the diagram of FIG. 3b, the Y-axis shows the yarn output $d'$ as a function of the position $p'$ (X-axis) of the cam bar 6 during the working travel of the cam 6a.

Assuming, for example, the cam bar 6 is displaced from left to right between two extreme positions $p'_1$ and $p'_2$ determined by the fixed stops 9 (see FIG. 1): conventionally, the travel of the cam bar 6 is always longer than that of the thrower bar 8 which is only driven by the cam bar 6, after the latter has already travelled a certain distance from $p'_1$ to $p'_4$, the position $p'_4$ corresponds, on the one hand, to the coming into contact of the cam bar 6 with the thrower bar 8 when it occupies the position $p_1$ determined by one of the end-of-travel stops 10, and, on the other hand, to the start of the stitch gathering.

The continuous signal representative of the position of the cam bar 6 and coming from the potentiometer 22 is sent to a comparator 42 which also receives the D.C. signal representative of the position of the end-of-travel stops 10 of the thrower bar 8, and transmitted by the potentiometer 30. When the difference of the signals received is representative of the distance $p'_3 - p'_4$ (FIG. 3b), $p'_3$ being of predetermined value, the comparator 42 transmits a logic signal which controls, by triggering-off the integrator 43, the start of an acceleration ramp $S_1$ which makes it possible progressively to reach the normal speed of the supply unit, when gathering. In the same manner, at the end of the gathering, when the difference of the signals received by the comparator 42 is representative of the predetermined distance from $p'_6$ to $p'_7$ where the point $p'_7$ corresponds to the position $p_2$ of the second end of travel stop 10 of the thrower bar 8 and also to the end of the gathering, the comparator 42 triggers-off the negative slope $S_2$. The distance from $p'_6$ to $p'_7$ is equal to the distance from $p'_3$ to $p'_4$, the two slopes $S_1$ and $S_2$ being of equal length and strictly symmetrical relatively to the points $M_A$ and $M_B$ whose vertical projection onto the straight line of the X-axes P' coincides with the points $P'_4$ and $P'_7$ representative of the start and end of the gathering, corresponding to the positions of the stops 10. The length of each slope is determined, on the one hand, by the predetermined value of half its horizontal projection $p'_3 - p'_4$, or $p'_6 - p'_7$ and by the fixed position of the middle point $p'_4$ or $p'_7$ of the said projection, and, on the other hand, by the normal speed of rotation of the pulley 13 of the feed unit 12, this being the normal speed required for gathering and a function of the speed of the cam bar 6. In order to achieve this, the integrator 43 receives the pulses coming from the circuit 39, for the differentiation and shaping of the pulses of encoder 20, linked to the cam bar 6, its slope (du/dt) is a function of the frequency of these input pulses and of their amplitude, and saturation will require a greater number of pulses as their amplitude decreases. The preliminary adjustment of the amplitude of the said pulses makes it therefore possible to control the slopes $S_1$ or $S_2$ in dependence on the speed of the cam bar 6, in such a manner as to preserve the strict symmetry of the said two slopes in relation to the start and end of the gathering.

The time scale of the acceleration and deceleration slopes, limiting the speed of the supply unit at the start and end periods of gathering, can be expressed as follows: the thrower bar 8 starts first, so that the thrower 3 has sufficient time to deposit a certain quantity of yarn in front of the needles, before the start of the gathering. At the time corresponding to the start $p'_3$ of the acceleration slope $S_1$ determined as previously explained, the pulley 13 of the supply unit 12 is subjected to a progressive acceleration which enables it to deliver a certain quantity of yarn, before the cam 6a has started the gathering. The proportion of this quantity of yarn which is not immediately required by the thrower is temporarily stored, by the yarn take-up device 48 to 52, and is thereafter progressively fed back to it from the moment when the gathering starts, so as to compensate for the difference between the output provided and the output required, caused by the difference between the acceleration of the yarn supply, theoretically required at this moment, and the actual acceleration provided. In the same manner, after the gathering has stopped, at the end of a row of knitting, the positive feed unit 12 continues to feed the yarn take up device 48 to 52, and the quantity of yarn thus stored will be used, to supply for the next row, the thrower 3 in the time period between its next start and the time when the positive feed unit 12 starts up again.

The adjustment of the length of yarn per stitch (LFD) is effected by means of a manual control device 44 which makes it possible to select the tension and acts on the impedance matcher 45 which receives the output voltage of the integrator 43. The action of the device 44 on the impedance matcher 45 consists in modifying the amplitude of the voltage received by the said impedance matcher 45, the said amplitude being proportional to the output of yarn.

In the same manner, the control of a "loose stitch" is effected by means of the control device 46 which acts similarly to the device 44, at the level of the impedance matcher 45. A "loose stitch" is one larger than the stitch formed in normal knitting; the modification will act in the sense of an increase of the amplitude of the output voltage signal of the impedance matcher 45. The operation of the loose stitch control action is obtained by a change of state of a contact, or by the transmission of a logic signal controlled at the correct time, by the knitting machine.

A logic device 41 acting both at the level of the impedance adaptor 40 and that of the ramp generating device 43 makes it possible, in two sets of circumstances, to block the signals outside the lateral knitting area. If, in effect, the travel of the cam bar 6, is greater than the width of the knitted piece of material, the device 41 then goes into action, at the end of a row of needles, so as to interrupt the transmission of pulses coming from the circuit 39, and representative of the displacement of the cam bar 6. In the same manner, on completion of the knitting of a piece of material, the release of the so-called "lost stitch" device MP, controls the action of the logic device 41 which blocks the information coming from the transducer 14 of the cam bar 6 and causes the inhibition of the control circuit 33 of each of the motors 34 and places the latter in an idling condition.

Figure 5:
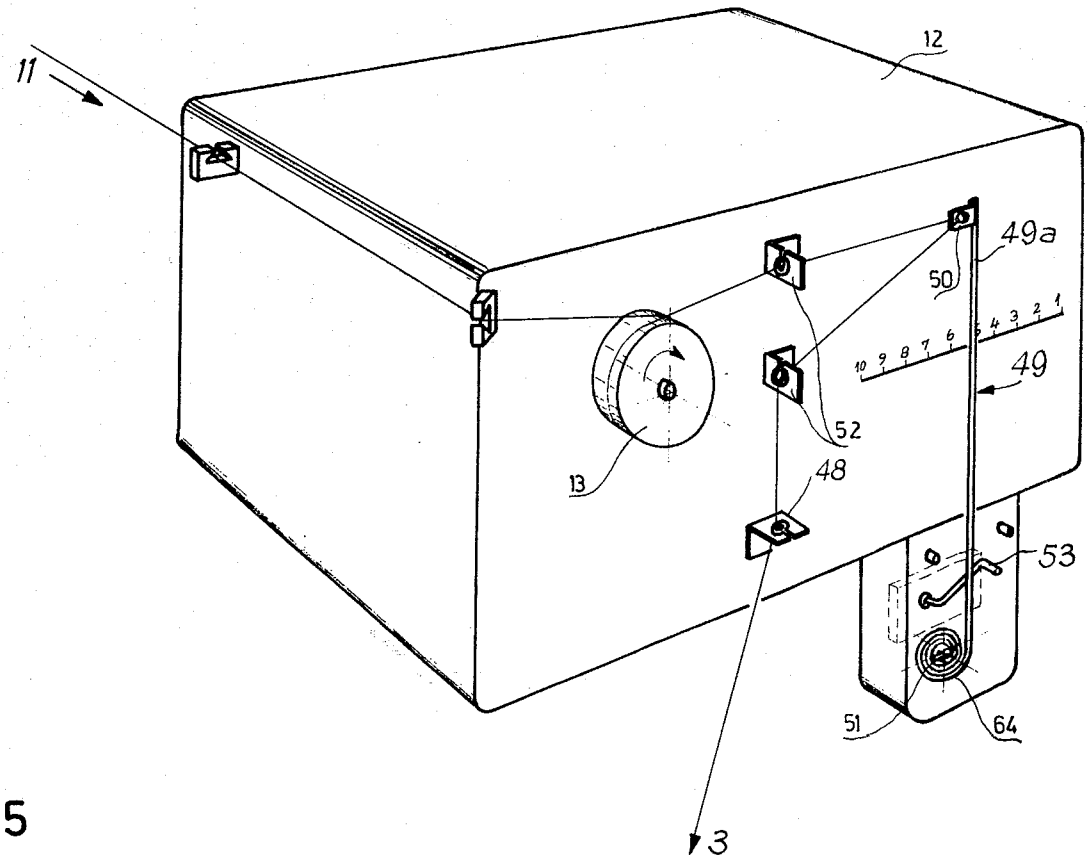
FIG. 5 is a perspective view of some mechanical parts of a feed unit forming part of an embodiment of the invention.

The positive feed units 12 (FIG. 5) form an essential part of the installation; their number is equal to that of the number of throwers 3 of the machine. As previously mentioned, each of the feed units 12 comprises a pulley 13 with a surface of high coefficient of friction, driven by a controlled electric motor 34 (FIG. 4) whose output is directly coupled to an optical encoder 47, rotating with the pulley 13. A control circuit 33 acts on the motor 34. The yarn take up device 49 to 52 is located between the pulley 13 and the fixed yarn-guide 48, and serves for temporarily storing the yarn supplied to but not taken up by the needles. The yarn 1 must not slip on the pulley 13 which must have a working surface capable of resisting the corrosive action of various yarn treatments (paraffin coating, textile oil coatings). Moreover, the inertia of the pulley must be low so that it is capable of sufficient acceleration and deceleration at the start and at the end of the gathering, by means of a motor of reasonable size. It is therefore made of a light moulded material and its track is surfaced with a thin rubber band which conforms to the above mentioned characteristics.

Preferably, the motor 34, is a D.C. motor with a low time constant.

The yarn take-up mechanism 49 to 52 is made necessary, as previously explained by the deliberate limitation of the acceleration and deceleration of the yarn supply at the start and at the end of the gathering. It is composed (FIG. 5) of a rod 49a with one end in the form of a calibrated spring 64, the other end being free and provided with a mobile eyelet or yarn-guide 50, made of, for example, ceramic material. A control 51 at the mounting point of the spring 64, makes it possible to adjust the initial tension of the yarn take-up device. A set of two yarn-guides 52 each located on either side of the mobile yarn-guide 50 in a vertical plane, makes it possible to guide the yarn 1 along a suitable operational path. A contact 53 controlled by the rod 49a of the yarn take-up device 49 functions as a yarn-break detector and makes it possible, in the case of a yarn-break, to trigger off a signal which stops the drive of the pulley 13.

The purpose of the circuit 33 is to control the rotational position of the drive motor 34 of the pulley 13, by means of the signals delivered, on the one hand, by the transducer 14 connected to the cam bar 6, and, on the other hand, by the transducer 15 connected to the thrower bar 8, and treated in the processing circuit 32.

The pulses coming from the shaping circuit 36 and representative of the displacement speed of the thrower 3 are modulated in amplitude in the modulating circuit 54, by the position signal of the said thrower 3, which signal is fed from the adaptor circuit 38 and takes into account the factor $(1 \pm \sin\alpha)$. In the same manner, the displacement pulses of the cam bar 6 delivered by the circuit adaptor 40 are modulated in amplitude in the modulating circuit 55 by the position signal of the said cam bar 6, which is fed from the impedance matching circuit 45. The output signals of the two modulators 54 and 55 are sent to the comparator 56 where they are stored.

An optical encoder 47 forming part of the pulley 13 delivers two alternating signals out of phase by $\pi/2$ whose period is representative of the rotation of the feed unit. These two signals are sent to a multiplier circuit 57 in which they are shaped, differentiated and summed to obtain a train of pulses having a step equal to one quarter of the period. These pulses act on a monostable switch 58 which delivers to a third input of the comparator 56, pulses of controlled width and amplitude. A logic device embodied in the comparator 56 makes it possible to store these pulses in the said comparator 56 so as to effect their algebraic summation with the control signals represents the thrower 3 and the cam 6a. The resulting voltage error signal, available at the output of the comparator 56, is amplified in the circuit 59 which directly controls the motor. The control is achieved when the voltage error is practically null, by little short of $\epsilon$ (this corresponds to the motor being kept running).

From the output pulses of the multiplier 57 whose frequency is representative of the speed of the pulley 13 and therefore of the motor 34, there is generated, by a direction detecting circuit 60 and a frequency-voltage converter 61, a tachometric damping signal which is introduced at the level of the amplifier 59 of the error signal, so as to ensure stability in the control of the motor 34.

The power supply of the motor 34, incorporated in the amplifier 59 is of conventional type and includes four semi-conductors controlled in pairs. This makes possible the reversal of the control current of the motor whilst the latter continues to rotate in the same direction, this condition is necessary in order to obtain a satisfactory transitory control response, particularly during deceleration.

Figure 8:
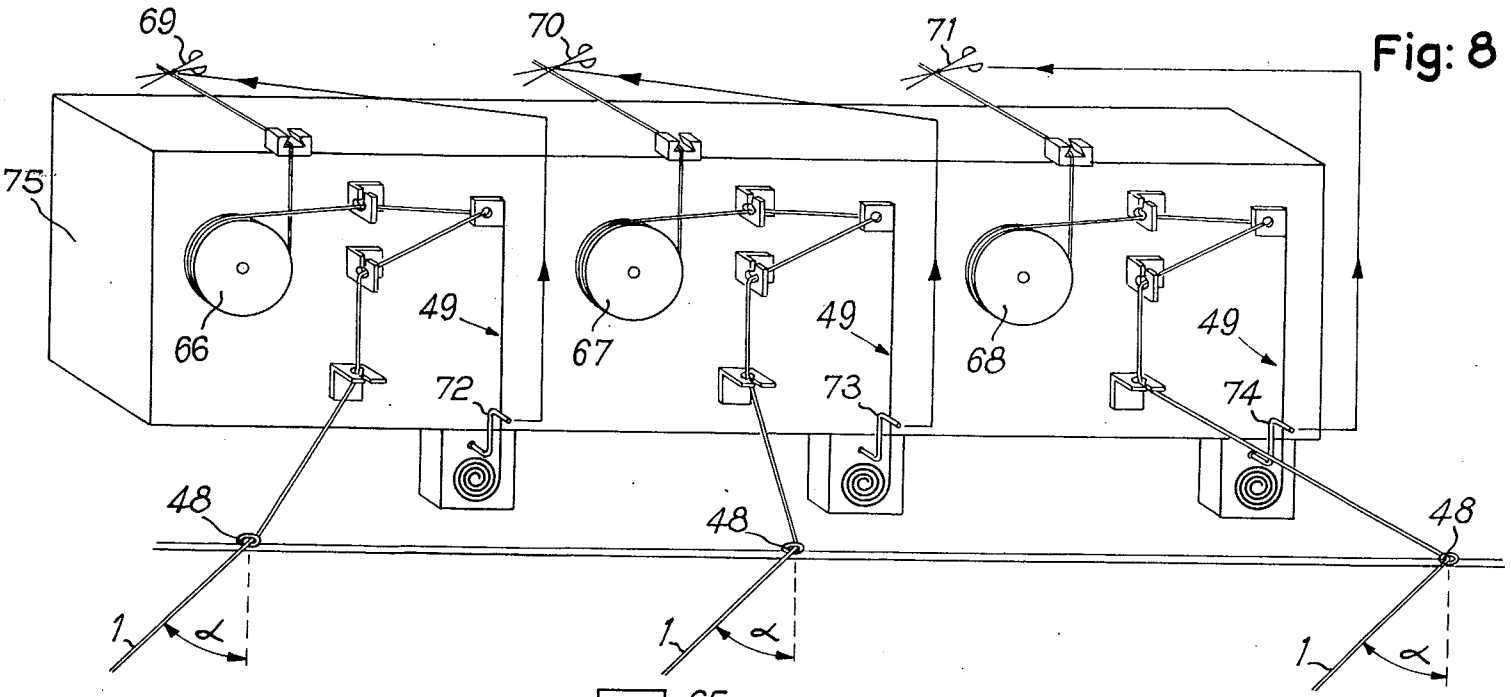
FIGS. 8 and 9 are a perspective view and a plan view of an alternative form of feed unit.
Figure 9:
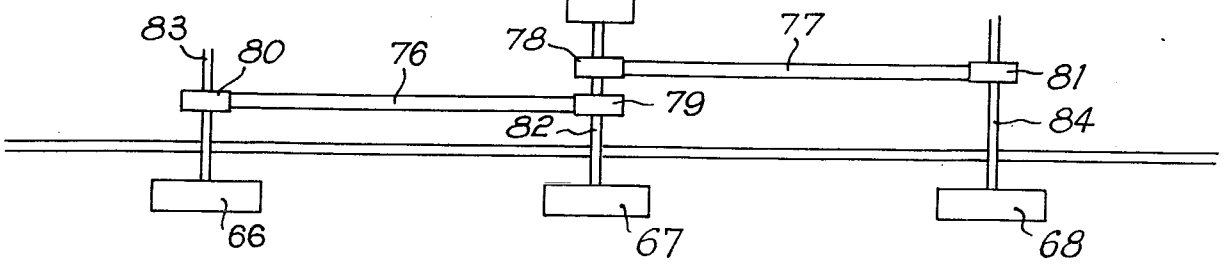

For reasons of production costs, a variation of the invention consists in driving (FIGS. 8 and 9) by means of a single controlled motor 65 (FIG. 9) of suitable size, and a number of notched belts 76, 77 and corresponding cog-wheels 78, 79, 80, 81, a number of pulleys such as 66, 67 and 68 located in a positive feed unit 75. In the assembly illustrated, there are three pulleys, but this number is not limitative. The central pulley 67 is directly mounted on the output shaft 82 of the motor 65, whilst the other pulleys 66 and 68 are mounted on shafts 83, 84 driven from the central shaft 82 on which the cog-wheels 78 and 79 are keyed. Each of these pulleys supplies a thrower and possesses its individual yarn take-up device 49. With this arrangement, in the event of a break in the yarn 1 feeding one of the throwers 3, the drive of the corresponding pulley 66, 67, 68, is not stopped, as in the previously described solution, but the yarn 1 is cut upstream of the pulley, by a suitable method such as a yarn-cutter 69, 70 or 71, whose operation is controlled by a yarn-break detector 72, 73 or 74; this is in order to allow normal work to proceed on the other knitting-heads not affected by the breakdown. Other arrangements can be envisaged, which allow the feed of several throwers to be effected by one controlled motor: for instance, a single pulley of sufficient length on which would be wound the yarns intended to feed a plurality of throwers, or a series of pulleys mounted on the same shaft and each driving a yarn, or even a combination of both these arrangements.

Figure 6:
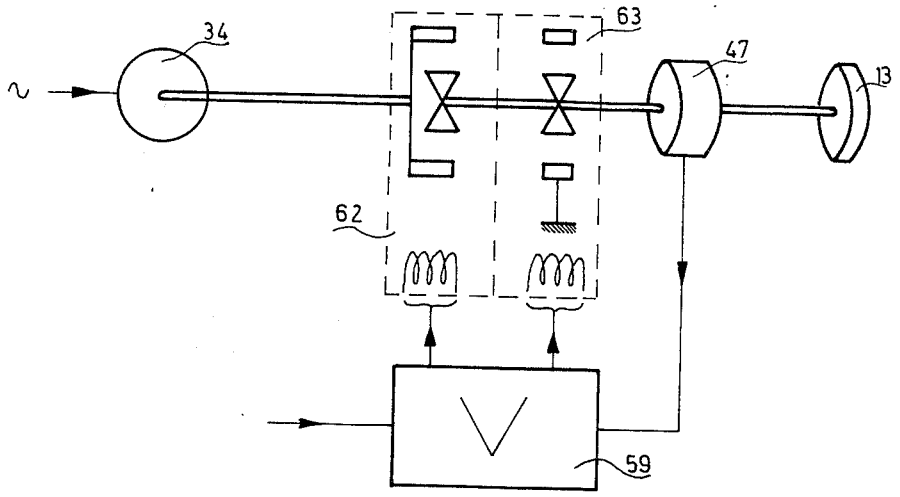
FIG. 6 illustrates an alternative form of drive motor control for the yarn feed unit.

It is possible to achieve, at the level of the motor 34 (FIG. 6) a control of different form, using, for instance, electro-magnetic couplers interposed between the said motor 34 and the pulley 13. The motor is then permanently rotated at a speed which exceeds the maximum speed of rotation of the pulley 13 driven by means of an assembly consisting of a forward drive coupler 62 and a brake coupler 63, an assembly which is, as previously, controlled by the signal coming from the amplifier 59.

Other arrangements can also be envisaged at the level of the information pick-up positions of the thrower 3 and the cam 6a. Such solutions would involve the use of, for instance, conventional incremental encoders or linear encoders coupled with the thrower and cam bars 6 and 8. The information supplied by these digital pick-ups can be treated in the above described manner, or by entirely digital methods. In this arrangement the position of the thrower and cam bars is determined in relation to the median plane P on the face, used as the base datum line; it is then necessary to provide logic signals which are representative of the median plane P and the position of the stops 10 of the thrower bar. These signals are supplied by optical or magnetic pick-ups mounted on the knitting machine, the cam bar being provided with a device capable of acting on these pick-ups. A logic adder/subtractor, followed by a digital-analogue converter restores the D.C. voltage proportional to the displacement of the thrower. This voltage is used for correcting the thrower. A logic assembly, using the information provided by the detection elements, makes it possible to trigger off acceleration and deceleration ramps, generated on the basis of the information coming from the cam. At the level of the control of the motors, either of the aforementioned arrangements may be used.

What is claimed is:

1. For a knitting machine of the type comprising a rectilinear array of needles, gathering and shaping sinkers for forming stitches in cooperation with said needles, a cam bar carrying a cam for actuation of said gathering sinkers, drive means driving said cam bar to reciprocate longitudinally of said rectilinear array of needles, a thrower bar carrying a thrower which guides the yarn onto the needles in said rectilinear array thereof, and means drivingly interlinking said cam bar and said thrower bar;

a yarn supply device operating to supply yarn to said thrower for feeding to said needles at a rate depending on the required stitch size, said yarn supply device comprising:

a yarn spool holding a supply of yarn to be knitted by said machine, a yarn feed unit for drawing yarn from said spool and driving it towards said thrower, a yarn take-up device for accommodating a temporary slack loop in said yarn as it is fed to said thrower, and a fixed yarn guide located in a plane extending perpendicular to said rectilinear array of needles at a position midway along the length thereof, the improvement wherein, said yarn feed unit includes a yarn drive member which is driven by an electrical drive system, first speed and position sensitive means sensitive to the speed and position of said cam bar, operating to produce electrical output signals in dependence thereon, second speed and position sensitive means sensitive to the speed and position of said thrower bar operating to produce electrical output signals in dependence thereon, and electrical control means connected to the outputs of said first and second speed and position sensitive means and operating to control said drive member of said yarn feed unit, whereby said yarn is fed in dependence on both the speed and position of both said cam bar and said thrower bar.

2. The yarn supply device of claim 1, wherein there are further provided adjustable end stops limiting the displacement of said thrower bar, and position sensitive means sensitive to the position of said end stops, and said electrical control means is also connected to the output of said position sensitive means to receive signals representing the position of said end stops, means sensitive to the speed of said drive member of said yarn feed unit to provide output signals in dependence thereon, and means connecting said means sensitive to the speed of said drive member of said yarn feed unit to said electrical control means which provides an error signal representing the difference between the desired and the actual speed of said yarn drive member of said yarn feed unit.

3. The yarn supply device of claim 1, wherein said first and second speed and position sensitive means are first and second transducer assemblies, and between said transducer assemblies and said electrical control means is connected a processing circuit operating to modify the transducer signals fed to said electrical control means in dependence on the instantaneous position of said thrower with respect to said fixed yarn guide and on the acceleration or deceleration of said yarn feed unit.

4. The yarn supply device of claim 3, wherein said transducer assemblies have input members mechanically connected to said cam bar or said thrower bar for movement therewith.

5. The yarn supply device of claim 3 wherein said transducer assemblies associated with said cam and thrower bars, each comprise a potentiometer having a wiper the position of which is dependent on the instantaneous position of the corresponding bar, and an encoder, such as an optical encoder, providing output electrical pulses representing the speed of displacement of the bar.

6. The yarn supply device of claim 3 wherein said transducer assembly associated with the end-of-travel stops of said thrower bar comprises a potentiometer the position of the wiper of which is dependent on the position of at least one of the said stops.

7. The yarn supply device of claim 3 wherein an input member of each of the transducer assemblies is connected to the associated movable bar by means of a notched or perforated belt which passes over two pulleys to form an elongate loop one branch of which extends parallel to the direction of displacement of the associated movable bar, this branch of the belt being connected to the associated movable bar so that the belt moves therewith, and one of the pulleys being mounted on a shaft forming the said input member of the associated transducer assembly.

8. The yarn supply device of claim 3 wherein said processing circuit includes an electronic device fed with the output signal from said second transducer assembly sensitive to the movement of said thrower bar and operable to modify this signal by a factor of $(1 \pm \sin\alpha)$, where $\alpha$ is the angle formed at any given moment, between the length of yarn between said fixed yarn-guide and said thrower, and said median plane of said needle bed, which passes perpendicularly through the direction of movement of said thrower bar.

9. The yarn supply device of claim 3 wherein said control circuit includes a comparator device connected to the output from said transducer of said first transducer assembly sensitive to the position of said cam and to the output of said transducer sensitive to the position of said end of travel stops, and operating to transmit a control signal when the difference between the signals from said transducers is representative of a predetermined distance.

10. The yarn supply device of claim 3 wherein said processing circuit comprises aan integrator device connected to the output from said comparator device, means connected to said integrator to feed thereto pulses representing the speed of displacement of said cam, said integrator operating to supply an output voltage proportional to the frequency and amplitude of the said input pulses.

11. The yarn supply device of claim 10, wherein there are provided manual adjustment means for adjusting the amplitude of said output signal from said integrator device in order to adjust the length of yarn fed per stitch.

12. The yarn supply device of claim 10 wherein there are provided means for producing an increase in the amplitude of the output signal from said integrator in dependence on the position in the piece of material being knitted, to form a so-called loose stitch.

13. The yarn supply device of claim 9 wherein said control circuit includes first amplitude modulator means, means connecting said first amplitude modulator means to said speed sensitive transducer of said second transducer assembly, for feeding to said first modulator a pulse signal representative of the speed of displacement of said thrower bar, means connecting said first modulator to said position sensitive transducer of said second transducer assembly for feeding to said modulator a D.C. signal representative of the position of said thrower, said modulator operating to modulate said pulse signal in dependence on said D.C. signal and to provide a modulated output voltage to said comparator of said control circuit.

14. The yarn supply device of claim 9 wherein said control circuit comprises a second amplitude modulator means, means connecting said second amplitude modulator means to said speed sensitive transducer of said first transducer assembly for feeding to said second modulator a pulsed signal representative of the speed of displacement of said cam bar, means connecting said second modulator means to said position sensitive transducer of said first transducer assembly for feeding to said second modulator a D.C. signal representative of the position of the said cam bar, said second modulator operating to modulate said pulsed signal with said D.C. signal and to provide a modulated output voltage to said comparator of said control circuit.

15. The yarn supply device of claim 14 wherein said control circuit includes a comparator connected to the output of said first and second amplitude modulators, and to means providing an electrical signal representative of the speed of rotation of the drive member of said yarn feed unit, said comparator operating to provide an error signal to a control amplifier acting on the electric drive system of said yarn feed unit.

16. The yarn supply device of claim 1, wherein there are provided a plurality of feed units with a single drive motor connected thereto by means of a non-slip transmission system, such as a notched or perforated belt and pulley arrangement.

17. The yarn supply device of claim 1, wherein said yarn take-up device is associated with an abutment contact which functions as a yarn-break detector operating to stop the drive of the or a corresponding feed unit, when a yarn break is detected.

18. The yarn supply device of claim 1, wherein said yarn take-up device is associated with an abutment contact which functions as a yarn break detector operating to actuate a yarn-cutter located upstream of the said feed unit.

19. The yarn supply device of claim 1, wherein said speed sensitive transducers are incremental encoders.

20. The yarn supply device of claim 1, wherein said electrical drive system comprises a continuously rotating motor, and a clutch assembly comprising an electro-magnetic drive coupler and an electro-magnetic brake coupler mounted between said motor and the or a corresponding feed unit.

* * * * *

UNITED STATES PATENT OFFICE

CERTIFICATE OF CORRECTION

Patent No. 3,962,891 Dated June 15, 1976

Inventor(s) GUY CHARLES ROUZAUD

It is certified that error appears in the above-identified patent and that said Letters Patent are hereby corrected as shown below:

On the title page, preceding [22], insert priority information:

-- France No. 74 09726, filed March 21, 1974 --

Signed and Sealed this

Twelfth Day of October 1976

[SEAL]

*Attest:*

RUTH C. MASON
*Attesting Officer*

C. MARSHALL DANN
*Commissioner of Patents and Trademarks*